US006960319B1

(12) United States Patent
Kapoor

(10) Patent No.: US 6,960,319 B1
(45) Date of Patent: Nov. 1, 2005

(54) TUNGSTEN ALLOYS FOR PENETRATOR APPLICATION AND METHOD OF MAKING THE SAME

(75) Inventor: Deepak Kapoor, Rockaway, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 08/540,620

(22) Filed: Oct. 27, 1995

(51) Int. Cl.[7] ..... B22F 3/14; C22C 1/04; C22C 27/04; F42B 12/06

(52) U.S. Cl. ..... 419/11; 419/12; 419/13; 419/14; 419/32; 419/48; 419/49; 29/1.23; 102/501; 102/517; 75/230; 75/243; 75/244; 75/248; 75/950; 420/431; 420/590

(58) Field of Search ..... 419/12, 13, 14, 419/32, 48, 49, 11; 29/1.23; 102/501, 517; 75/230, 243, 244, 248, 950; 420/431, 590

(56) References Cited

U.S. PATENT DOCUMENTS 3,888,636 A * 6/1975 Sczerzenie et al. ..... 29/182
3,979,234 A * 9/1976 Northcutt, Jr. et al. ..... 148/126
4,749,410 A * 6/1988 Mullendore et al. ..... 75/248
4,784,690 A * 11/1988 Mullendore ..... 75/248
4,981,512 A * 1/1991 Kapoor ..... 75/248
4,990,195 A * 2/1991 Spencer et al. ..... 148/11.5 F
5,064,462 A * 11/1991 Mullendore et al. ..... 75/248
H1075 H * 7/1992 Kapoor ..... 420/430
5,145,512 A * 9/1992 Spencer et al. ..... 75/248
H1146 H * 3/1993 Kapoor ..... 148/673
5,462,576 A * 10/1995 Stuitje et al. ..... 75/248

* cited by examiner

*Primary Examiner*—Charles T. Jordan
*Assistant Examiner*—Daniel Jenkins
(74) *Attorney, Agent, or Firm*—Saul Elbaum; Edward Goldberg; John E. Callaghan

(57) ABSTRACT

Disclosed is a flow-softening tungsten alloy having the general formula:

$$W_{100-p}A_iB_jC_kD_e$$

wherein W is tungsten; A is one or more elements selected from the group consisting of nickel, iron, chromium and cobalt; B is in or more elements selected from the group consisting of molybdenum, niobium and tantalum; C is one or more of the elements selected from the groups consisting of titanium and aluminum; D is one or more elements selected from the group consisting of boron, carbon, and silicon; i is from about 5 to about 8 weight percent; j is from 0 to about 4 weight percent; k is from about 0.1 to about 4 weight percent; 1 is from 0 to about 0.1 weight percent; and p is greater than or equal to about 7 weight percent and less than or equal to about 20 weight percent. In this alloy p is approximately equal to the sum of i, j, k and 1. A method of preparing this alloy and a kinetic energy penetrator manufactured from it are also disclosed.

23 Claims, 6 Drawing Sheets

TUNGSTEN ALLOYS FOR PENETRATOR APPLICATION AND METHOD OF MAKING THE SAME

BACKGROUND OF THE INVENTION

1. Field of the Invention

The present invention relates to tungsten alloys and more particular to flow-softening tungsten alloys for use in kinetic energy penetrators.

2. Brief Description of the Prior Art

The high density of tungsten heavy alloys (WHA) makes them suitable candidates for kinetic energy penetrator application. However, the penetration performance of WHA's kinetic energy (long rod) projectiles is inferior to that of equivalent projectiles made of depleted uranium alloys. Despite the superior performance of depleted uranium munitions, there are many environmental and/or political concerns associated with their manufacturing and use in the battlefield. These concerns have prompted continuing efforts within the United States Army to develop tungsten heavy alloys which are capable of equalling or surpassing the performance of depleted uranium alloys.

Prior research efforts seeking improvement in the penetration capability of WHA's have focused on improved mechanical properties of WHA's and have been unsuccessful. Recent studies of the United States Army Laboratories, however, have established that it is the rate at which the penetrator material softens, under the high rate, high pressure deformation it must undergo in the penetration process, not the materials mechanical properties which governs its performance. The rapid flow-softening behavior of uranium alloys, a function of both their mechanical and thermal properties, was shown to be responsible for their superior ballistic performance.

SUMMARY OF THE INVENTION

This invention relates to an alloy development approach to designing novel, isotropic, plastically unstable tungsten alloys. A second objective of present invention is to develop a process for preparing tungsten based plastically unstable alloys. Another objective of the present invention to show that flow-softening in tungsten based alloys can be achieved by replacing a nickel based matrix in conventional tungsten heavy alloys with a thermomechanically unstable alloy and that flow-softening tungsten alloys show improved ballistic penetration over the classical WHA's.

The alloy of the present invention relies primarily on modification and replacement of the nickel based matrix in the conventional WHA's with a thermomechanically less stable alloy. Critical issues include the roles and interactions between the novel matrix and the tungsten phase on the thermomechanical properties of the overall composite, and the nucleation and growth of plastic instability in these novel composites having the general formula:

$$W_{100-p}A_iB_jC_kD_l$$

wherein W is tungsten; A is one or more elements selected from the group consisting of nickel, iron, chromium and cobalt; B is one or more elements selected from the group consisting of molybdenum, niobium and tantalum; C is one or more elements from the group consisting of titanium and aluminum; D is one or more elements from the group consisting of boron, carbon and silicon. Also, i is from 5–8 weight percent, j is from 0–4 weight percent, k is from 0.1–4 weight percent, l is from 0–0.1 weight percent, and p equals i+j+k+l and $20 \leq p \geq 7$ weight percent. The composition and amount of A, B, C and D are adjusted to form a thermomechanically unstable phase.

In another aspect, the invention is directed to a method for preparing a novel flow-softening tungsten alloy.

In still another aspect, the invention is directed to a kinetic energy penetrator comprising a novel flow-softening tungsten alloy.

BRIEF DESCRIPTION OF THE DRAWINGS

FIG. 1(*b*) is a photograph similar to FIG. 1(*a*) showing a $W_{90}Ni_{5.2}Cr_2Fe_{1.8}Mo_{0.32}Nb_{0.52}Al_{0.06}TiO_{0.1}$ alloy;

FIG. 1(*c*) is a photograph similar to FIG. 1(*a*) showing a $W_{90}Ni_{4.94}Cr_2Fe_{0.5}Mo_1Co_{1.1}Al_{0.15}Ti_{0.3}C_{0.01}$ alloy;

FIG. 1(*d*) is a photograph similar to FIG. 1(*a*) showing a $W_{90}$-$Ni_{2.8}$-$(Ni_3Al)_6$-$Fe_{1.2}$ alloy;

FIG. 2(*b*) is an optical microscope photograph showing a tungsten-Tm unstable matrix residual penetrator.

DETAILED DESCRIPTION OF THE PREFERRED EMBODIMENTS

Figure 1A:
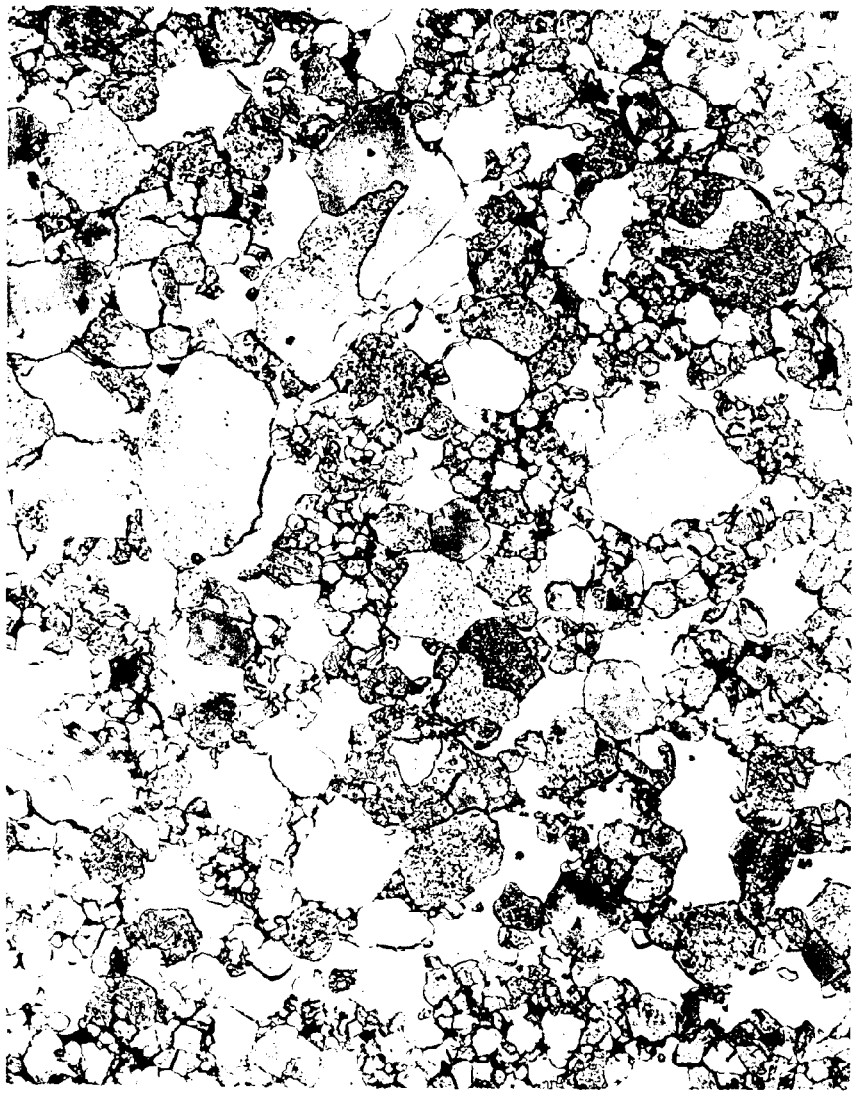
FIG. 1(*a*) is an optical microscope photograph showing a $W_{90}$-$(Ni_3Al)_{10}$ alloy at a scale of 1 cm being equal to 50 $\mu$m.
Figure 1B:
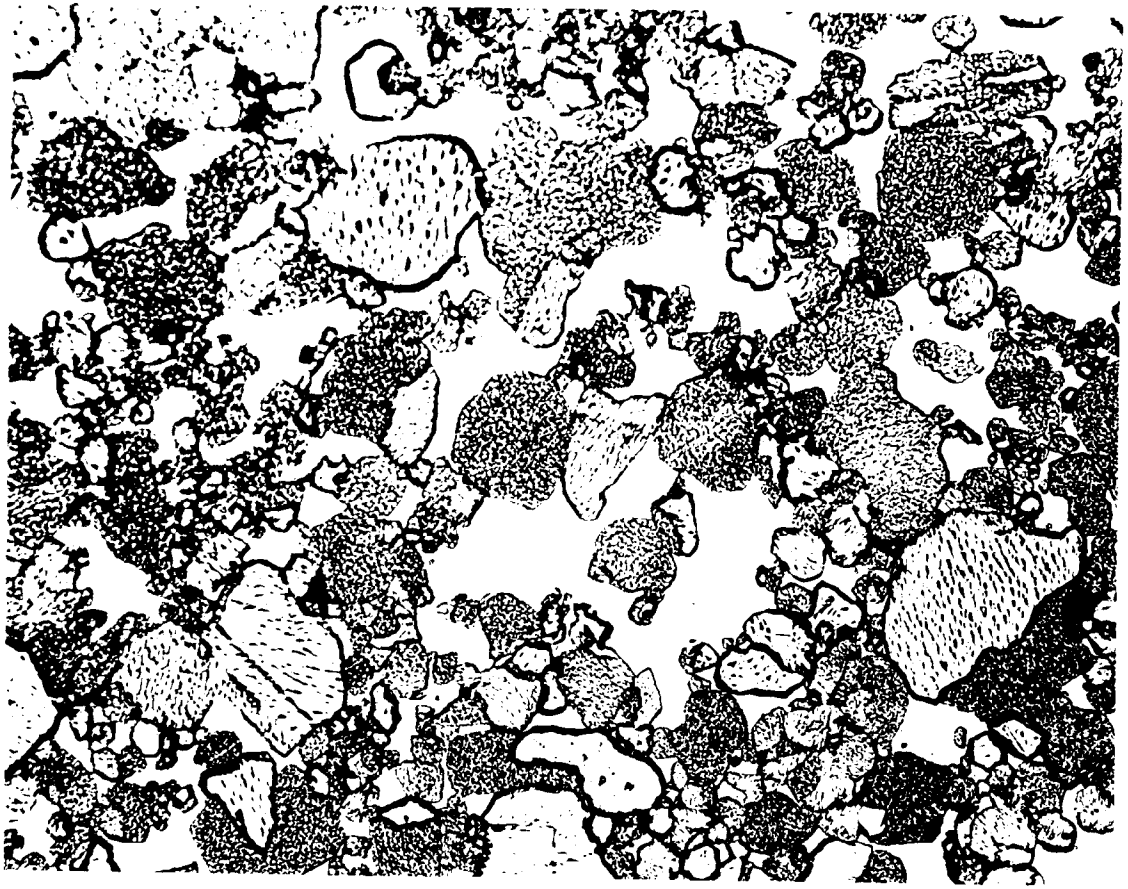
Figure 1C:
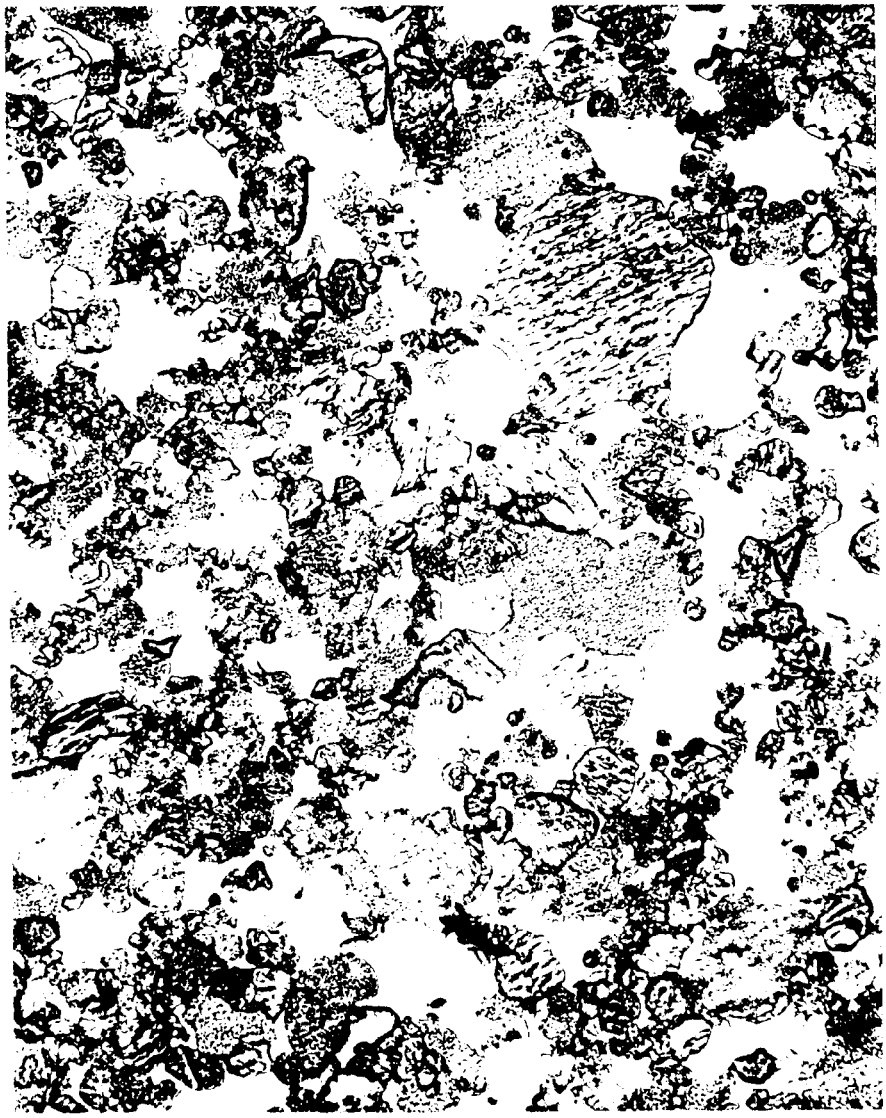
Figure 1D:
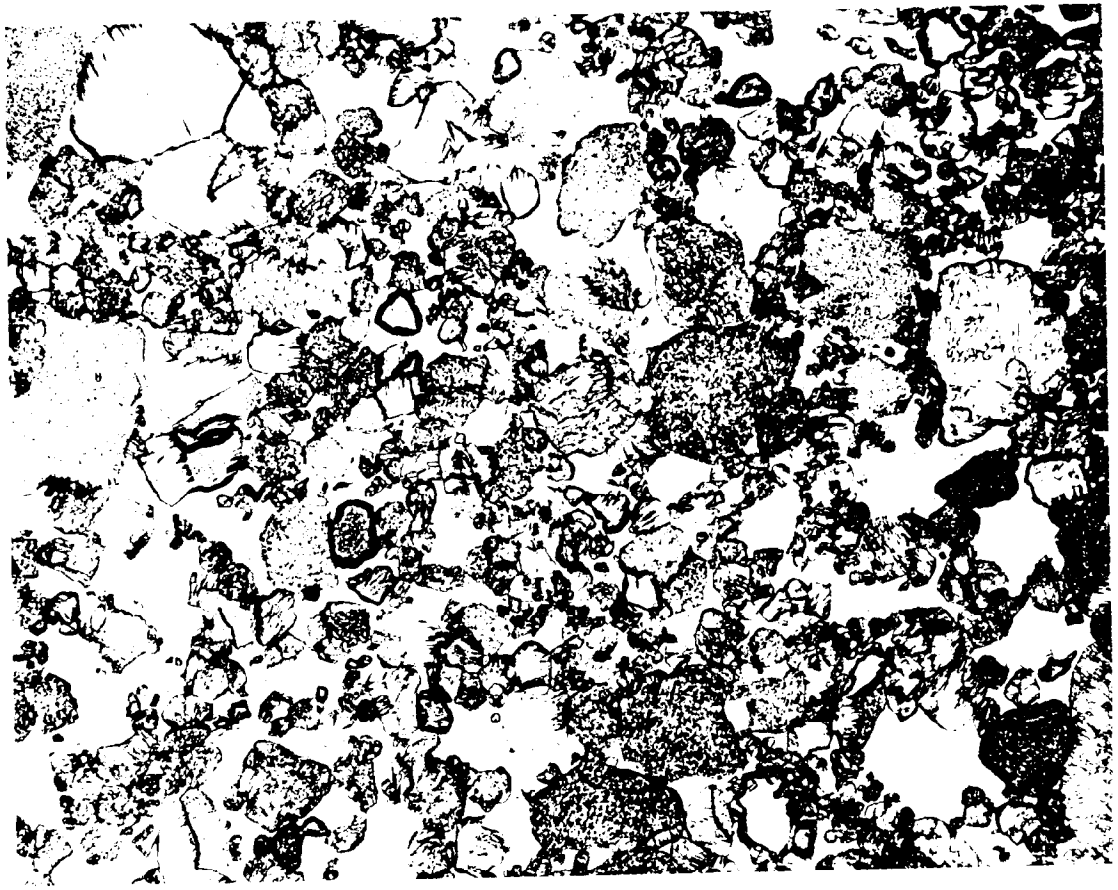

The process selected and the processing variables need to be optimized to prevent formation of intermetallic phases in the microstructure. It is preferred to avoid melting of any component of the selected composition since it may cause degradation of properties of overall composite. The process comprises the steps of blending a mixture of the powdered, elemental components or alloys, and hot consolidating the blended powder to near full density. In the first step, a mixture of high purity elemental powders, or prealloyed powders corresponding to the components of a desired alloy are blended using typical powder blenders well known in the art. It is desired to control the powder particle size of component A, B, C, D or the prealloyed powder consisting of A+B+C+D so as to have a uniform distribution of tungsten particles in a continuous and homogeneous matrix.

The thoroughly blended powder mixture is then hot consolidated at temperatures high enough to achieve near full density but lower than the incipient melting temperature of either component A, B, C or D, or the prealloyed powder made from A, B, C, D. Hot consolidation techniques are well known in the art and include, for example, hot isostatic pressing (HIPping), hot extrusion and hot pressing. Preparation of large quantities of the novel tungsten alloy according to the invention is preferably carried out using hot isostatic pressing and/or hot extrusion.

The hot consolidated novel tungsten alloys are further analyzed for density and microstructure. X-ray and electron microscopic techniques are utilized to further characterize the alloys. Near full density material is machined to a sub-scale test specimen and subjected to reverse ballistic testing to screen alloys which undergo flow-softening under high strain-rate ballistic impact condition. It is expected that alloys exhibiting flow-softening will show improvement in their ballistic penetration capability over the conventional WHA's.

To more fully illustrate this invention, the following examples are presented.

EXAMPLES

Tungsten powder and prealloyed powders of composition $(Ni_{63.5}Cr_{20}Fe_3Mo_9Nb_{3.5}Al_{0.4}Ti_{0.6})$, ($Ni_{52.1}Cr_{20}Fe_{18}Mo_{3.2}Nb_{5.2}Al_{0.45}Ti_{1.0}C_{0.07}$) and ($Ni_{49.4}Cr_{20}Fe_5Mo_{10}Co_{11}Al_{1.5}Ti_3C_{0.1}$) are blended to produce blends consisting of 80–90 weight percent of tungsten and 10–20 weight percent of prealloyed powder. The average particle size of tungsten powder is 70 μm and the average particle size of aforementioned prealloyed powders is about 25 μm. The incipient melting range of prealloyed powder is 1288° C.–1349° C., 1210° C.–1344° C. and 1316° C.–1371° C. respectively. All the blends of tungsten powder and the prealloyed powders were hot consolidated by hot isostatic pressing at 1150–1200° C., well below the incipient melting temperature of the prealloyed powders. In another set of experiments, tungsten powder and prealloyed nickel-aluminide or iron-aluminide powders are blended together with or without the addition of elemental nickel and iron powders to produce blends consisting of 90 weight percent of tungsten and 10 weight percent of the additives. These blends are also hot consolidated by hot isostatic pressing at 1150° C. Table I lists the compositions of all the novel alloys fabricated under this invention along with the processing conditions. The HIPped densities of the various blends ranged between 98%–99.7% of their theoretical densities. Microstructural analysis conducted on the hot consolidated alloys revealed a uniform distribution of tungsten particles in a continuous matrix phase. FIG. 1 shows the microstructure of some of these alloys. Sub-scale test specimen were machined out of each hot consolidated bar and subjected to reverse ballistic test to screen flow-softening and nonflow-softening tungsten alloys. One common feature of alloys under this invention is the presence of aluminide phase in the microstructure.

Figure 2A:
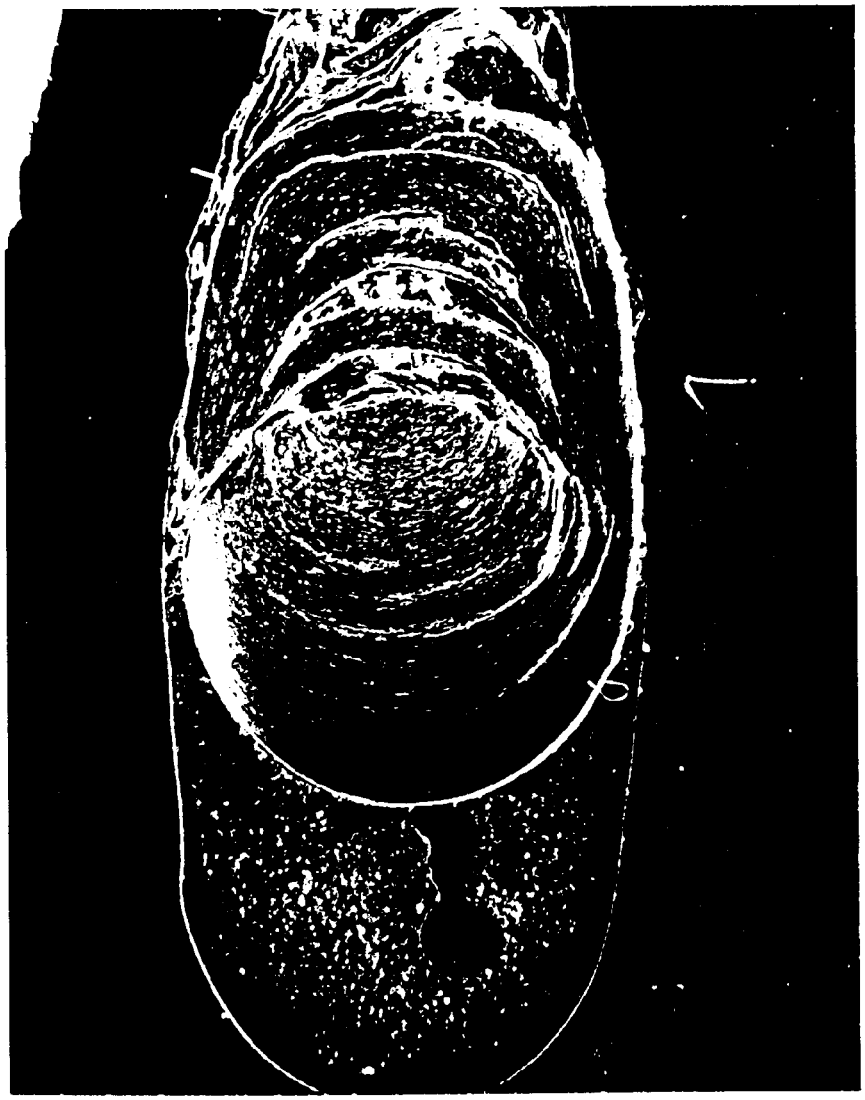
FIG. 2(*a*) is an optical microscope photograph showing a tungsten-Tm stable matrix residual penetrator.
Figure 2B:
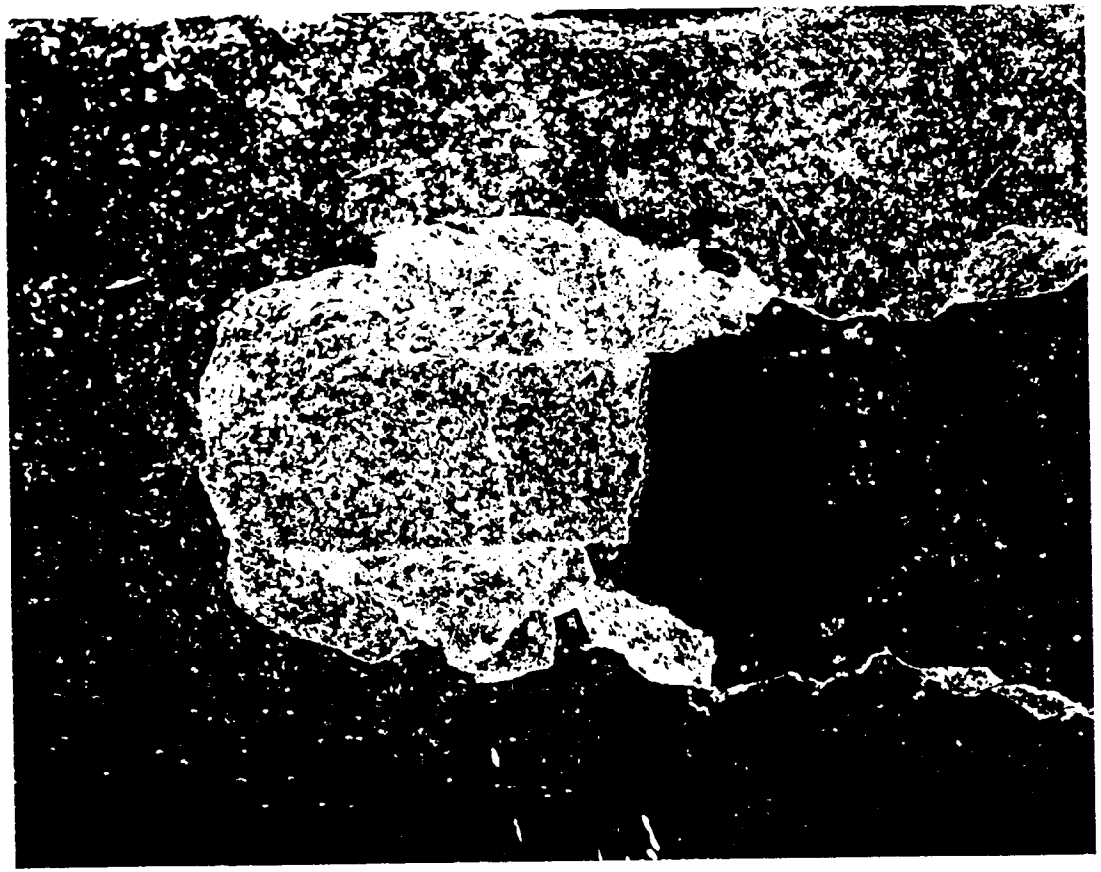

Table I also includes composites such as tungsten-copper, tungsten-nickel, tungsten-iron and tungsten-nickel-iron, which are outside the scope of this invention and so not reveal flow-softening because the matrix component of these alloys i.e. copper, nickel and iron are thermomechanically stable. These compositions have been included for comparison purpose only. FIG. 2 shows the difference in macrostructure of two tungsten alloys after reverse ballistic testing. The alloy with themomechanically stable matrix i.e. $W_{90}Ni_7Fe_3$ undergoes a large plastic deformation whereas the material with thermomechanically unstable matrix i.e. $W_{90}Ni_{4.94}Cr_{20}Fe_{0.5}Mo_1Co_{1.1}Al_{0.15}Ti_{0.3}C_{0.01}$ shows plastic flow localization or flow-softening. The relevance of flow-softening lies in the fact that all those alloys in Table I which reveal this phenomenon also show much improved ballistic penetration compared to those compositions which so not undergo flow-softening. Additionally, a minimum matrix percentage is required to flow-soften the novel tungsten alloy.

In the final set of examples, elemental tungsten powder was blended with either prealloyed $Ni_{49.4}Cr_{20}Fe_5Mo_{10}Co_{11}Al_{1.5}Ti_3C_{0.1}$ or nickel aluminide powder to produce tow blends consisting essentially of 90% by weight to tungsten and 10% by weight of prealloyed $Ni_{49.4}Cr_{20}Fe_5Mo_{10}Co_{11}Al_{1.5}Ti_3C_{0.1}$ and 90% by weight of tungsten and 10% by weight of nickel aluminide ($Ni_3Al$). The average particle size of tungsten powder is 70 μm and the average particle size of the prealloyed powder and nickel aluminide powder is 20 μm and 25 μm respectively. The blended powders are hot consolidated by extrusion at a preheat temperature of 1150° C. and with an extrusion ratio of 5:1.

The extrusion billets were fully dense and exhibited elongated tungsten grains within the respective matrix phase. The extruded tungsten alloys also revealed flow-softening when exposed to reverse ballistic testing. The flow-softening once again led to an improvement in the ballistic penetration performance of these alloys, when compared to the nonflow-softening tungsten-nickel-iron alloy.

In accordance with the invention, novel tungsten alloys showed flow-softening behavior and an improved penetration performance as compared to conventional WHA's.

While preferred embodiments of the invention have been described, it is to be understood that the scope of the invention is defined by the following claims.

TABLE I

| Alloy Composition Wt. % | Process Conditions | REVERSE BALLISTIC SCREENING Flow-Softening? |
|---|---|---|
| $W_{90}Ni_{6.35}Cr_2Fe_{0.3}Mo_{.9}Nb_{.35}Al_{.04}Ti_{.06}$ | 1150° C./4 H, 30,000 PSI | Marginal |
| $W_{80}Ni_{12.7}Cr_4Fe_{0.6}Mo_{1.8}Nb_{.7}Al_{.08}Ti_{.12}$ | 1150° C./4 H, 30,000 PSI | Marginal |
| $W_{90}Ni_{5.2}Cr_2Fe_{1.8}Mo_{.32}Nb_{.52}Al_{.06}Ti_{0.1}$ | 1150° C./4 H, 30,000 PSI | Marginal |
| $W_{80}Ni_{10.4}Cr_4Fe_{3.6}Mo_{.64}Nb_{1.04}Al_{.08}Ti_{.2}$ | 1150° C./4 H, 30,000 PSI | Yes |
| $W_{90}Ni_{4.94}Cr_2Fe_{.5}Mo_1Co_{1.1}Al_{.15}Ti_{.3}C_{.01}$ | 1150° C./4 H, 30,000 PSI | Yes |
| $W_{80}Ni_{9.88}Cr_4Fe_1Mo_2Co_{2.2}Al_{.3}Ti_{.6}C_{.02}$ | 1150° C./4 H, 30,000 PSI | Yes |
| $W_{90}(Ni_3Al)_{10}$ | 1150° C./4 H, 30,000 PSI | Yes |
| $W_{80}(Ni_3Al)_{20}$ | 1150° C./4 H, 30,000 PSI | Yes |
| $W_{90}(Fe_3Al)_{10}$ | 1150° C./4 H, 30,000 PSI | Yes |
| $W_{80}(Fe_3Al)_{20}$ | 1150° C./4 H, 30,000 PSI | Yes |
| $W_{90}Ni_{4.2}(Ni_3Al)_4Fe_{1.8}$ | 1150° C./4 H, 30,000 PSI | Yes |
| $W_{90}Ni_{3.5}(Ni_3Al)_5Fe_{1.5}$ | 1150° C./4 H, 30,000 PSI | Yes |
| $W_{90}Ni_{2.8}(Ni_3Al)_6Fe_{1.2}$ | 1150° C./4 H, 30,000 PSI | Yes |
| $W_{90}Ni_{2.1}(Ni_3Al)_7Fe_{0.9}$ | 1150° C./4 H, 30,000 PSI | Yes |
| $W_{90}Ni_{1.4}(Ni_3Al)_8Fe_{0.6}$ | 1150° C./4 H, 30,000 PSI | Yes |
| $W_{90}Ni_{2.8}(Fe_3Al)_6Fe_{1.2}$ | 1150° C./4 H, 30,000 PSI | Yes |
| $W_{90}Cu_{10}$ | Liquid Phase Sintered | No |
| $W_{80}Cu_{20}$ | Liquid Phase Sintered | No |
| $W_{90}Fe_{10}$ | 1050° C./4 H, 30,000 PSI | No |
| $W_{80}Fe_{20}$ | 1050° C./4 H, 30,000 PSI | No |
| $W_{90}Ni_{10}$ | 1150° C./4 H, 30,000 PSI | No |
| $W_{80}Ni_{20}$ | 1150° C./4 H, 30,000 PSI | No |
| $W_{90}Ni_7Fe_3$ | Liquid Phase Sintered | No |

What is claimed is:

1. A composition comprising a metallic alloy having the general formula:

$$W_{100-p}A_iB_jC_kD_e$$

wherein W is tungsten; A is one or more elements selected from the group consisting of nickel, iron, chromium and cobalt; B is in or more elements selected from the group consisting of molybdenum, niobium and tantalum; C is one or more of the elements selected from the groups consisting of titanium and aluminum; D is one or more elements selected from the group consisting of boron, carbon, and silicon; i is from about 5 to about 8 weight percent; j is from 0 to about 4 weight percent; k is from about 0.1 to about 4 weight percent; l is from 0 to about 0.1 weight percent; and p is greater than or equal to about 7 weight percent and less than or equal to about 20 weight percent.

2. The composition of claim 1 wherein p is approximately equal to the sum of i, j, k and l.

3. The composition of claim 1 which exhibits flow-softening characteristics.

4. The composition of claim 1 wherein the composition has a microstructure without intermetallic phases.

5. The composition of claim 1 wherein the composition has a microstructure with an aluminide phase.

6. The composition of claim 1 wherein the composition and amount of A, B, C and D are adjusted to form a thermomechanically unstable phase.

7. A method for preparing a flow-softening tungsten alloy comprising the steps of:

(a) forming a mixture of metallic powders having the general formula:

$$W_{100-p}A_iB_jC_kD_e$$

wherein W is tungsten; A is one or more elements selected from the group consisting of nickel, iron, chromium and cobalt; B is in or more elements selected from the group consisting of molybdenum, niobium and tantalum; C is one or more of the elements selected from the groups consisting of titanium and aluminum; D is one or more elements selected from the group consisting of boron, carbon, and silicon; i is from about 5 to about 8 weight percent; j is from 0 to about 4 weight percent; k is from about 0.1 to about 4 weight percent; l is from 0 to about 0.1 weight percent; and p is greater than or equal to about 7 weight percent and less than or equal to about 20 weight percent; and (b) hot consolidating the mixture formed in step (a).

8. The method of claim 7 wherein in step (a) p is approximately equal to the sum of i, j, k and l.

9. The method of claim 7 wherein in step (a) the mixture comprises high purity elemental powders.

10. The method of claim 7 wherein in step (a) the mixture comprises a prealloyed powder corresponding to the components of the desired alloy.

11. The method of claim 7 wherein in step (a) the mixture contains a uniform distribution of tungsten particles in a continuous and homogeneous matrix.

12. The method of claim 7 wherein in step (a) the metallic powders are thoroughly blended.

13. The method of claim 8 wherein in step (b) the powder mixture is hot consolidated at temperatures which are high enough to achieve near full density but which are lower than the incipient melting temperatures of A, B, C and D.

14. The method of claim 7 wherein in step (b) the powder mixture is hot consolidated at temperatures which are high enough to achieve near full density but lower than the incipient melting temperatures of the prealloyed powder.

15. The method of claim 7 wherein in step (b) hot consolidation is carried out by hot isostatic pressing.

16. The method of claim 7 wherein in step (b) hot consolidation is carried out by hot extrusion.

17. The method of claim 7 wherein in step (b) hot consolidation is carried out by hot pressing.

18. A kinetic energy penetrator comprised of a composition having the general formula:

$$W_{100-p}A_iB_jC_kD_e$$

wherein W is tungsten; A is one or more elements selected from the group consisting of nickel, iron, chromium and cobalt; B is in or more elements selected from the group consisting of molybdenum, niobium and tantalum; C is one or more of the elements selected from the groups consisting of titanium and aluminum; D is one or more elements selected from the group consisting of boron, carbon, and silicon; i is from about 5 to about 8 weight percent; j is from 0 to about 4 weight percent; k is from about 0.1 to about 4 weight percent; l is from 0 to about 0.1 weight percent; and p is greater than or equal to about 7 weight percent and less than or equal to about 20 weight percent.

19. The kinetic energy penetrator of claim 18 wherein p is approximately equal to the sum of i, j, k and l.

20. The kinetic energy penetrator of claim 18 wherein the composition of which it is comprised exhibits flow-softening characteristics.

21. The kinetic energy penetrator of claim 18 wherein the composition of which it is comprised has a microstructure without intermetallic phases.

22. The kinetic energy penetrator of claim 18 wherein the composition of which it is comprised has a microstructure with an aluminide phase.

23. The kinetic energy penetrator of claim 18 wherein in the composition of which it is comprised amounts of A, B, C and D are adjusted to form a thermomechanically unstable phase.

* * * * *